United States Patent [19]

Yamamoto et al.

[11] Patent Number: 4,771,960

[45] Date of Patent: Sep. 20, 1988

[54] METHOD FOR WINDING A CROSS-WOUND PACKAGE

[75] Inventors: Shigeru Yamamoto, Matsuyama; Soichi Miyamoto, Takatsuki, both of Japan

[73] Assignees: Teijin Seiki Co., Ltd.; Toyo Boseki Kabushiki Kaisha, both of Osaka, Japan

[21] Appl. No.: 122,592

[22] Filed: Nov. 18, 1987

Related U.S. Application Data

[63] Continuation of Ser. No. 830,656, Feb. 18, 1986, abandoned.

[30] Foreign Application Priority Data

Feb. 20, 1985 [JP] Japan ..... 60-30637
Apr. 22, 1985 [JP] Japan ..... 60-85957

[51] Int. Cl.[4] ..... B65H 54/38; B65H 54/32
[52] U.S. Cl. ..... 242/18.1; 242/43 R; 242/43.1
[58] Field of Search ..... 242/18.1, 43 R, 43.1

[56] References Cited

U.S. PATENT DOCUMENTS

| | | | |
|---|---|---|---|
| 2,345,601 | 4/1944 | Hickes | 242/43 R |
| 3,089,657 | 5/1963 | Chaussy | 242/43 R |
| 3,310,248 | 3/1967 | Have | 242/43 R |
| 4,296,889 | 10/1981 | Martens | 242/18.1 |
| 4,325,517 | 4/1982 | Schippers et al. | 242/18.1 |
| 4,498,637 | 2/1985 | Yamamoto et al. | 242/18.1 |
| 4,544,108 | 10/1985 | Maurer | 242/18.1 X |
| 4,555,069 | 11/1985 | Maeda et al. | 242/18.1 X |

*Primary Examiner*—Stanley N. Gilreath
*Attorney, Agent, or Firm*—Burgess, Ryan and Wayne

[57] ABSTRACT

A method for winding a cross-wound package comprising, while shoulders of the packages are leveled, turning one of traverse ends at a traverse speed of zero, accelerating rapidly to a predetermined traverse speed, traveling to the other traverse end at the predetermined traverse speed, decelerating rapidly at a position just before the other traverse end, and turning the other traverse end at a traverse speed of zero, characterized in that a rate of change of the traverse speed is changed at least once during changing operation between the traverse speed of zero and the predetermined traverse speed.

4 Claims, 7 Drawing Sheets

FIG. 14 (a)

| NO. | 1 | 2 | 3 | 4 | 5 | 6 | 7 | ... | 101 | 102 | 103 | ... |
|---|---|---|---|---|---|---|---|---|---|---|---|---|
| RANDOM NUMBER | 03 | 47 | 43 | 73 | 86 | 36 | 96 | ... | 56 | 34 | 26 | ... |

FIG. 14 (b)

| NO. | 1, 2, 3, ..., 100, | 101, 102, ..., 190, | 191, 192, ..., 260, | ...999, 1000 |
|---|---|---|---|---|
| POSITION | 0, 0, 0, ... 0, | 1, 1, ..., 1, | 2, 2, ..., 2, | n, n |
| | 100 POINTS | 90 POINTS | 70 POINTS | 50 POINTS |

FIG. 14(c)

REPLACING STEPS

| POSITION | FORMER NO. | RANDOM NUMBER | CALCULATION | NEW NO. |
|---|---|---|---|---|
| 0 | 1 | 03 | 03 x 1 / 100 = 0.03 | 0 |
| 0 | 2 | 47 | 47 x 2 / 100 = 0.94 | 0 |
| 0 | 3 | 43 | 43 x 3 / 100 = 1.29 | 1 |
| 0 | 4 | 73 | 73 x 4 / 100 = 2.92 | 2 |
| . | . | . | . | . |
| . | . | . | . | . |
| . | . | . | . | . |
| 1 | 101 | 56 | 56 x 101 / 100 = 56.56 | 56 |
| 1 | 102 | 34 | 34 x 102 / 100 = 34.68 | 34 |
| 1 | 103 | 26 | 26 x 103 / 100 = 26.78 | 26 |
| . | . | . | . | . |
| . | . | . | . | . |
| . | . | . | . | . |

METHOD FOR WINDING A CROSS-WOUND PACKAGE

This application is a continuation of application Ser. No. 830,656, filed Feb. 18, 1986, now abandoned.

BACKGROUND OF THE INVENTION

TECHNICAL FIELD OF THE INVENTION

The present invention relates to a method for winding a cross-wound package. More particularly, the present invention relates to operational control of a traverse guide between a turning point to another turning point during the winding operation of a cross-wound package while the shoulders of the package are leveled.

The present invention is generally applicable to winding of any type of cross-wound package, and it is especially suitable for winding yarns, such as a covered yarn, which are relatively thick and wherein a core yarn is wrapped by other wrapping yarns.

The present invention will now be explained with reference to a covered yarn.

DESCRIPTION OF THE PRIOR ART

Since a covered yarn is relatively thick and has wrapping yarns wrapped about a core yarn, the ability of a yarn to be unwound from a package of a covered yarn, which ability will be referred to as "unwinding ability" hereinafter, may easily be degraded because of entanglement of snarls of yarns located at the surface of the covered yarn not only when ribboning occurs in the package but also when the distance between adjacent wraps on the package is small.

In order to prevent the unwinding ability from being degraded, it is advantageous to prevent ribboning from occurring. Further, leveling of shoulders of a package by changing turning points of traverse motion in an axial direction, and accordingly, by changing traverse strokes is also advantageous to prevent ribboning from occurring, which leveling is also called "wobbling" or "creeping".

A conventional traverse device arranged in a cross winding apparatus comprises a cylindrical cam having a helical groove formed thereon, a guide having a guide groove extending in an axial direction of a bobbin, a cam follower guided by the helical groove of the cylindrical cam and the guide groove of the guide, and a traverse guide fixed to the cam follower so as to traverse a yarn. When leveling operation is taking place in such a conventional traverse device, the inclination of the guide provided with the guide groove is changed against the axis of the bobbin by means of a cam member, such as a eccentric cam, so as to vary the traverse strokes. Although the peripheral profile of the cam can be designed at will, excessively suddenly changing cam profile cannot be used in order to achieve an ability of a cam follower for following a cam and durabilities of a cam and cam follower. Accordingly, in a conventional method for leveling shoulders of a cross-wound package, traverse strokes cannot be suddenly changed.

More specifically, when attention is paid to an end of a cross-wound package, it is impossible to traverse a yarn in such a manner that a first turning point of the traverse stroke nears the outermost turning point, i.e., the turning point in the maximum traverse stroke, in certain double strokes, and then a second turning point moves away from the outermost turning point to the innermost turning point in the next double strokes, and then, a third turning point nears to the outermost turning point in further double strokes.

Accordingly, in a conventional operation for leveling shoulders of a cross-wound package, shoulders cannot be fully leveled, and in some cases, ribboning of a package, high shoulders at the ends of a package, or partial increase of hardness of a package cannot be entirely prevented from occurring. Especially, in such a yarn as a covered yarn wherein a core yarn is covered by other wrapping yarns, snarls of wrapping yarns may easily entangle with each other, when adjacent wraps are closely located. As a result, even when usual ribboning does not occur, the package cannot be easily unwound. Further, since a covered yarn is bulky compared with its thickness, rising the formation of high or raised shoulders may occur easily.

In order to obviate the above-described problems, the present inventors developed a method for leveling shoulders of a cross-wound package, which comprises rotatably supporting a bobbin for winding a yarn thereon, and connecting a traverse guide, which is traversed to and fro along the axis of said bobbin, to a means for reversible movement via a traverse rod, the method characterized by changing the switching timing of said reversible movement means in such a manner that an imaginary line connecting turning points of traverse motion at each of the package ends on a traverse stroke vs time duration diagram forms bending points at every turning point.

According to this method, shoulders of a package can be fully leveled, and ribboning of a package, the formation of high shoulders at ends of a package, or partial increase of hardness of a package can be entirely prevented from occurring. Especially, even in such a yarn as a covered yarn wherein a core yarn is covered by wrapping yarns, entanglement of wrapping yarns can be prevented from occurring since adjacent wraps are separated from each other. As a result, a yarn having relatively large thickness can be wound in a package without forming high shoulders.

When this developed method is actually taking place, effects for preventing ribboning will be increased if a range for leveling shoulders, i.e., the distance between the outermost position of the traverse tuning point and the innermost position of the traverse turning point, is increased.

However, if the leveling range is set large in order to enhance the effects for preventing ribboning, the amount of yarn wound at ends of a package becomes excessively small, and the shoulders at the ends become rounded. In other words, the shoulders are sloped, and accordingly, a problem, which is sometimes referred to as "cob-webbing" and wherein a yarn wound on the shoulders is slipped down from the shoulders, may occur. Further, if the leveling range is increased, the winding tension in yarn located at turning points is lowered, and accordingly, the hardness of the ends of a package may be decreased, or bulges from the side surface of a package may occur. As a result, unwinding ability of a package may be degraded, and the leveling of shoulders, which is intended to prevent ribboning and enhance unwinding ability of a package, may become meaningless.

Especially, in a winding operation of a yarn having a very large elasticity, such as a covered yarn, since the winding tension may be excessively lowered, and therefore, since the yarn deposited at the shoulders is contracted and moves toward the center of a package in an axial direction, adjacent wraps may become close to each other and may be entangled with each other. Thus, there may occur a problem that the unwinding ability of a package is degraded. This problem may occur easily, if the time duration required for the turning operation is shortened.

Consequently, the change of the traverse strokes must be set taking into consideration not only prevention of ribboning but also influence to the shape of shoulders of a package.

When the above-described method is actually taking place, it is possible to control the traverse motion by sequentially inputting all the turning points of all the traverse strokes into a control system. However, this method is very troublesome and consumes a large amount of human labor, since all the turning points of all the traverse strokes have to be input again, when the shape of shoulders of a package is required to be changed. Contrary to this, if the turning points are simply repeated with a certain frequency in view of the passage of time, ribboning may be caused. Accordingly, turning points have to be set taking into consideration both the shape of shoulders and prevention of ribboning, and therefore, setting of the turning points requires skill. As a result, there causes a problem that the shape of shoulders cannot be easily altered.

SUMMARY OF THE INVENTION

An object of the present invention is to provide a method for winding a cross-wound package, by which slip down of a wound yarn and ribboning are prevented from occurring.

According to the present invention, the above-described object is achieved by a method for winding a cross-wound package comprising, while shoulders of the packages are leveled, turning at one of the traverse ends at a traverse speed of zero, accelerating rapidly to a predetermined traverse speed, traveling to the other traverse end at the predetermined traverse speed, decelerating rapidly at a position just before the other traverse end, and turning the other traverse end at a traverse speed of zero, characterized in that a rate of change of the traverse speed is changed at least once during the changing operation between the traverse speed of zero and the predetermined traverse speed.

Further, according to the present invention, a method for setting the condition for leveling shoulders of a cross-wound package is provided. The method comprises rotatably supporting a bobbin for winding a yarn thereon, connecting a traverse guide, which is traversed to and fro along the axis of the bobbin, to a means for reversible movement via a traverse rod, and changing switching timing of the reversible movement means in such a manner that an imaginary line connecting turning points of traverse motion at each of package ends on a traverse stroke vs time duration diagram forms bending points at every turning point, characterized by:

setting an innermost switching point at a position inside from an outermost switching point of traverse stroke of the reversible movement means by a leveling range;

dividing a zone between the outermost switching point and the innermost switching point into a plurality of points:

allotting frequencies to the plurality of points;

preparing switching points, the number of which corresponds to the frequencies:

disposing the prepared switching points substantially at random: and performing traverse motion turning at the substantially randomly disposed points in accordance with a basic traverse pattern, which is set based on shoulder shapes of the cross-wound package.

BRIEF DESCRIPTION OF THE DRAWINGS

The present invention will now be explained in detail with reference to some embodiments illustrated in the accompanying drawings, wherein:

FIG. 14 (*a*), FIG. 14 (*b*) and FIG. 14 (*c*) are diagrams explaining a step for randomly depositing the turning points.

DESCRIPTION OF THE PREFERRED EMBODIMENTS

Figure 1:
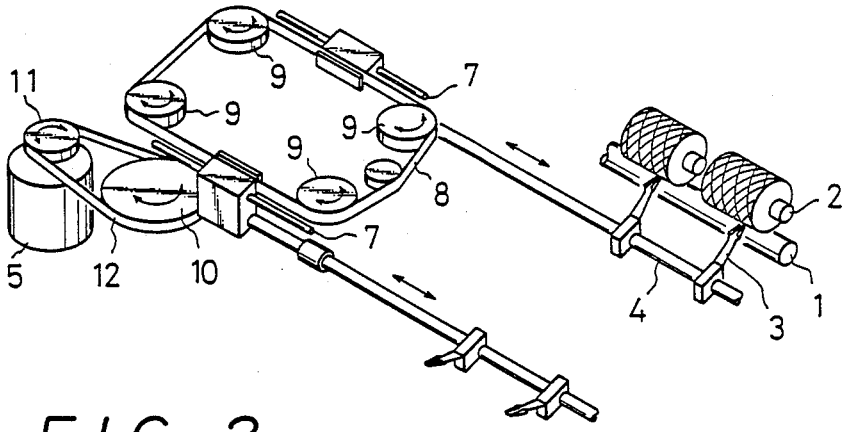
FIGS. 1 through 3 are perspective views of apparatuses for cross winding a yarn, wherein method for leveling shoulders of a package according to the present invention is carried out.
Figure 2:
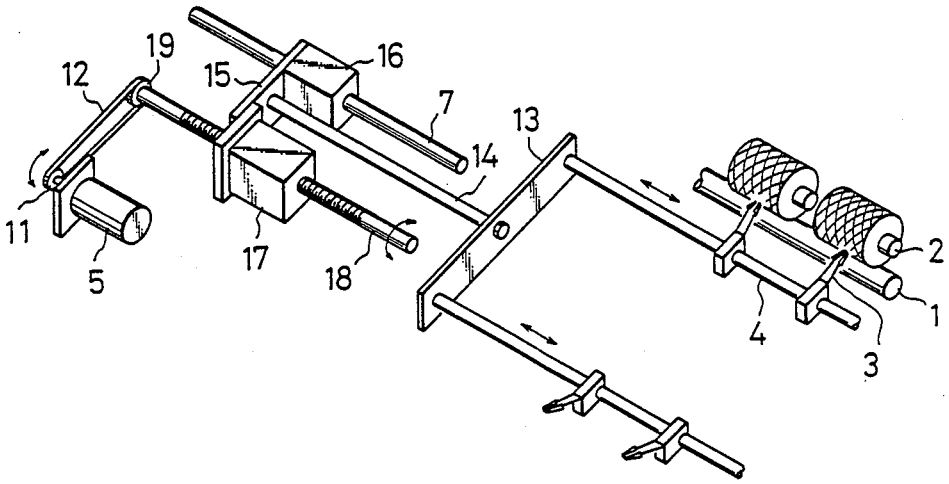
Figure 3:
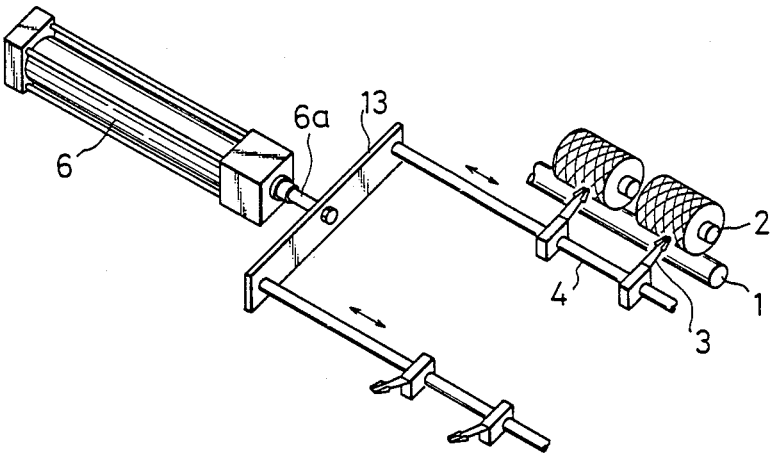

FIGS. 1 through 3 are perspective views of apparatuses, respectively, for carrying out the present invention.

A friction roller 1 is connected to a drive source (not shown) and is driven at a predetermined speed. Bobbins 2, which are used to wind yarns thereon, are rotatably supported and are frictionally engaged with the friction roller 1. Traverse guides 3, which perform a traverse motion in an axial direction of the bobbins 2, are fixed to traverse rods 4. The traverse rods 4 are connected to a means for reversible movement, such as an AC, i.e., alternating current, servo motor 5 (in FIGS. 1 and 2), a DC, i.e., direct current, servo motor, a stepping motor, or a hydraulic cylinder 6 (in FIG. 3).

More specifically, in FIG. 1, a pair of traverse rods 4 are supported in such a manner that they can reciprocate along guide rails 7, and the traverse rods 4 are connected to each other by means of a transmitting member, such as a timing belt 8. The timing belt 8 is wrapped around pulleys 9. A pulley 10 is coaxially disposed with one of the pulleys 9, a pulley 11 is fixed to the output shaft of the AC servo motor 5, and a transmitting member, such as a timing belt 12, is wrapped around the pulleys 10 and 11. Accordingly, the traverse guides 3 are traversed to and fro along the bobbins 2 by switching the rotating direction of the AC servo motor 5.

In FIG. 2, a pair of traverse rods 4 are connected to each other by means of a bracket 13, which is connected to another bracket 15 via a connecting rod 14.

The bracket 15 extends between a slide block 16, which is movable along the guide rail 7, and a block 17, which is movable along a screw shaft 18. A transmitting member, such as a timing belt 12, is wrapped around a pulley 19, which is fixed to an end of the screw shaft 18, and a pulley 11, which is fixed to an output shaft of the AC servo motor 5. Accordingly, the traverse guides 3 are traversed to and fro along the bobbins 2 by switching the rotating direction of the AC servo motor 5, and accordingly, the rotating direction of the screw shaft 18.

In FIG. 3, a piston rod 6*a* of the hydraulic cylinder 6 is directly connected to a bracket 13, which has a construction similar to that of the bracket 13 illustrated in FIG. 2. Accordingly, the traverse guides 3 are traversed to and fro along the bobbins 2 by actuating the piston rod 6*a* of the hydraulic cylinder 6.

In such apparatuses as illustrated in FIGS. 1 through 3, the switching timing of the reversible movement means is controlled in such a manner that an imaginary line connecting turning points of traverse motion at each of the package ends on a traverse stroke vs time duration diagram forms bending points at every turning point. Specifically, a turning point is a point at the end of the traverse stroke that is, at the end of the package, where the velocity is zero and a change of direction occurs. A bending point is a bend in the imaginary line such as the chain line in FIG. 6 that connects the turning points.

It has been found that effects for preventing ribboning will be increased if a range for leveling shoulder, i.e., the distance between the outermost position of the traverse tuning point and the innermost position of the traverse turning point, is increased. However, if the leveling range is set large, there is a tendency that the shoulders of a package are sloped, and accordingly, there occurs a problem that a yarn wound on the shoulders is slipped down from the shoulders.

According to the investigation conducted by the present inventors, it was found that the relationships between the leveling range and occurrence of the yarn slip down depend on the kind of the yarn to be wound, the conditions for winding the yarn, and so on. It was also found that the relationship is basically affected by the rate of the change of the traverse speed at the turning points, if the kind of yarn to be wound and the conditions for winding the yarn are unchanged.

Figure 4:
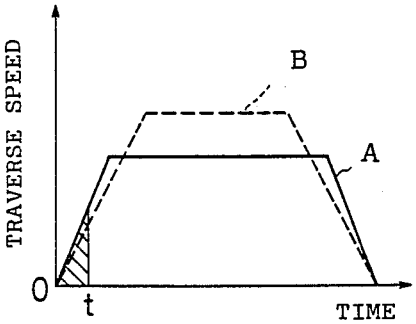
FIG. 4 is a diagram showing the relationship between time and traverse speed.

This will now be discussed in detail. FIG. 4 is a diagram showing the relationship between time and traverse speed, wherein time is plotted on the abscissa and traverse speed is plotted on the ordinate.

The traverse speed line A designated by a solid line in FIG. 4 accelerates rapidly to a predetermined traverse speed after it has turned the turning points, and it moves toward the other turning point at the predetermined traverse speed, and then it decelerates rapidly and turns the turning point.

Contrary to this, the acceleration to a predetermined traverse speed and the deceleration from the predetermined traverse speed are lowered in the traverse speed line B designated by a broken line compared with the traverse speed line A. Since the times consumed upon the acceleration and the deceleration along the traverse speed line B are larger than those consumed upon the acceleration and the deceleration along the traverse speed line A, the predetermined traverse speed for the traverse speed line B is set higher than that for the traverse speed line A so as to traverse the same amount of yarn in the same traverse time.

Figure 5:
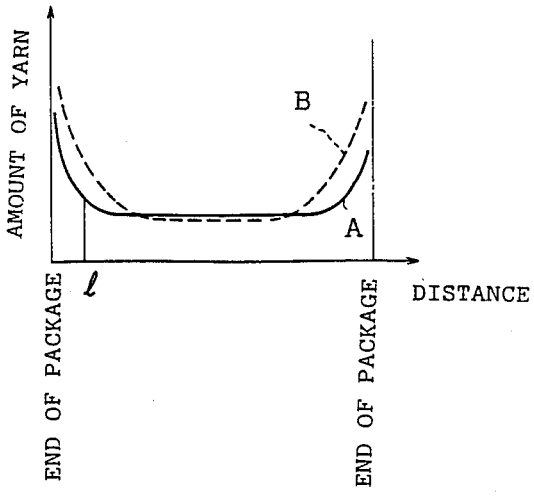
FIG. 5 is a diagram showing the relationship between position in a package and the amount of yarn wound on the package.

FIG. 5 is a diagram showing the relationship between position in a package and the amount of yarn wound on the package, wherein distance measured from one end of a package is plotted on the abscissa and amount of wound yarn is plotted on the ordinate. FIG. 5 is obtained from FIG. 4 in the following manner.

If a certain time t is taken on the abscissa in FIG. 4, the area, which is surrounded by the abscissa and the traverse speed A and which is hatched with oblique parallel lines, designates a traverse distance 1 of the traverse speed line A from the turning point in time t, and a point is plotted at a position spacing by distance 1 on the abscissa in FIG. 5. A yarn fed at a constant speed is traversed at the traverse speed A in time t designated in FIG. 4, and accordingly, an amount of yarn, which is proportional to a reciprocal of the traverse speed line A, is deposited on the package. Similar steps are repeated for all the times to calculate the distances and the amounts of wound yarn for the traverse speed lines A and B, and accordingly, a diagram illustrated in FIG. 5 is obtained.

If a yarn is traversed in accordance with the traverse speed lines A and B, designated by the solid line and the broken line, respectively, provided that the traverse width is constant, high shoulders are formed at the turning points of the traverse motions as illustrated by a solid line A and a broken line B in FIG. 5, because the traverse speeds are low during the acceleration and deceleration. More specifically, according to the traverse speed line B, which has slow traverse speed regions near the turning points as illustrated by the broken line in FIG. 4, a larger amount of yarn is deposited at regions near the turning points compared with the traverse speed line A, and accordingly, larger high shoulders are formed.

Figure 6:
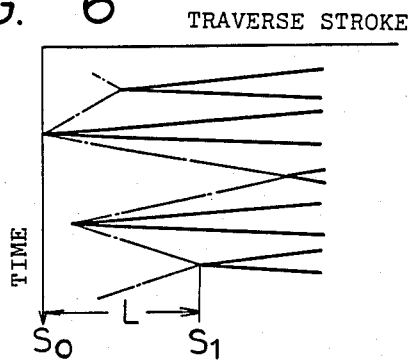
FIG. 6 is a diagram showing traverse stroke pattern for leveling shoulder of a package.
Figure 7:
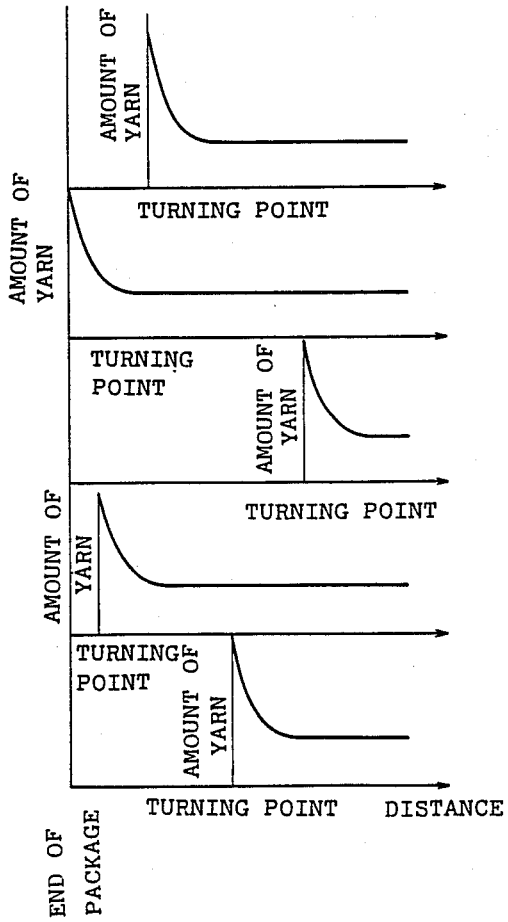
FIG. 7 is a diagram explaining the method for simulating the pattern of a high shoulder while the shoulder is leveled.

When the leveling of the shoulders of a package is taken place as illustrated in FIG. 6, a number of shoulder patterns which have been obtained in accordance with steps described with reference to FIG. 5 are prepared and are overlapped at turning points as illustrated in FIG. 7. In short, this means that the high shoulders illustrated in FIG. 5 at a certain turning point are distributed in a leveling range.

Incidentally, according to the experiences conducted by the present inventors, it was found that a certain minimum amount of high shoulders, which amount is determined in accordance with the kind of the wound yarn, has to be formed in order to avoid slipping down of the wound yarn from the shoulder when the leveling of the shoulders is performed. It is the inventors' opinion that when the leveling operation is performed and is macroscopically observed, the shoulder patterns are prepared for all the turning points and are distributed as described above, however, at a certain instance, a certain shoulder pattern is drawn, and a certain minimum amount of high shoulder is necessary to avoid slipping down of the wound yarn even during this instance.

If it is assumed that the minimum amount of shoulders is constant to avoid slipping down of the wound yarn, the traverse speed line B designated by a broken line in FIG. 4 creates a larger amount of high shoulders as illustrated by a broken line B in FIG. 5, and accordingly, the leveling range can be widened. In other words, the high shoulders can be distributed in a wider range compared with the traverse speed line A. As a result, if the acceleration of the traverse speed is small as designated by the broken line B in FIG. 4, the leveling range can be wide while slipping down of the wound yarn is avoided.

However, if the acceleration of the traverse speed is excessively small, the time duration wherein the traverse speed is low at the turning points is prolonged, and the winding tension in the yarn around the turning points is lowered. Consequently, a large difference in tension occurs between the normal traversing regions and the traverse turning regions, and there causes a problem of a winding tension variation in yarn wound on a package.

The excessive lowering of the winding tension in yarn located at turning points causes the decrease of the hardness of the shoulder ends of a package, or the bulge from the side surface of a package due to the slipping of yarn layer wound under a low tension. As a result, unwinding ability of a package is degraded, and the leveling of shoulders, which is intended to prevent ribboning and enhance unwinding ability of a package, may become meaningless. Especially, in a winding operation of a yarn having a number of snarls, such as a covered yarn, adjacent wraps may be easily entangled with each other. Thus, the unwinding ability of a package is degraded when a yarn is unwound from a package, which has a low hardness at the shoulders or bulges on the side surface.

Figure 11:
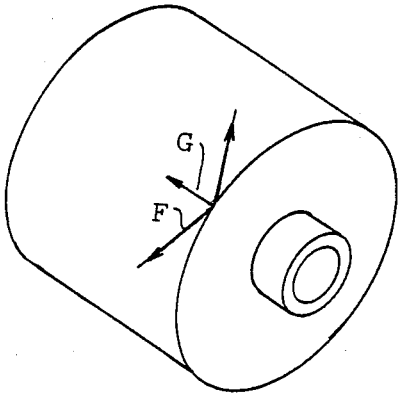
FIG. 11 is a perspective view explaining contracting force effect on a yarn located at shoulders of a package.

Since a covered yarn has a very large elasticity, a force G directed to the center of a package width is generated in the yarn wound at the shoulders due to the contracting force F created in the yarn as illustrated in FIG. 11. The yarn deposited at the shoulders moves toward the center of the package width with the passage of time after it is wound on the package. Thus, adjacent wraps may become close to each other and may be entangled with each other. Consequently, there may occur a problem that the unwinding ability of a package is degraded.

The deformation of the shoulders with the passage of time can be decreased if the traverse speeds at the acceleration and the deceleration are lowered. However, in this case, as described above, the hardness of the shoulder is decreased and a bulge is caused from the side surfaces, and therefore, the unwinding ability is adversely affected.

Figure 8:
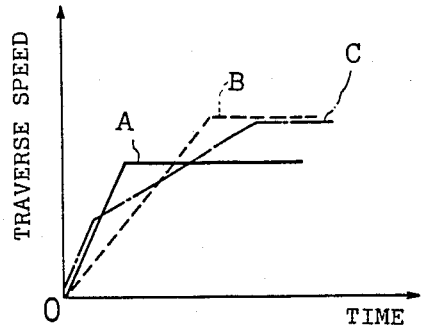
FIG. 8 is a diagram showing the relationship between time and traverse speed of the present invention.

The present invention has been developed in order to obviate the above-described problems. In FIG. 8, showing the relationship between time and traverse speed, a solid line A designates a critical traverse speed line, by which the variation in tension in the shoulders does not occur, and a broken line B designates a traverse speed line, by which slipping of the wound yarn does not occur and ribboning can be fully prevented from occurring. A dot and dash line C designates the traverse speed line according to a method of the present invention.

According to the embodiment of the present invention illustrated in FIG. 8, the rate of change of the traverse speed is decreased at least once during accelerating operation from the traverse speed of zero to the predetermined traverse speed. More specifically, as designated by a dot and dash line C, at the beginning of the accelerating operation, the traverse speed is changed along the traverse speed line designated by the solid line A. When the traverse speed is enhanced to such an extent that it does not adversely affect the tension variation in wound yarn, the rate of change in traverse speed is decreased lower than the traverse speed designated by the broken line B, so that the time duration for accelerating the traverse speed is prolonged later than that by the traverse speed line B. Thus, the amounts of high shoulders are substantially the same for the cases designated by traverse speed lines B and C.

Figure 9:
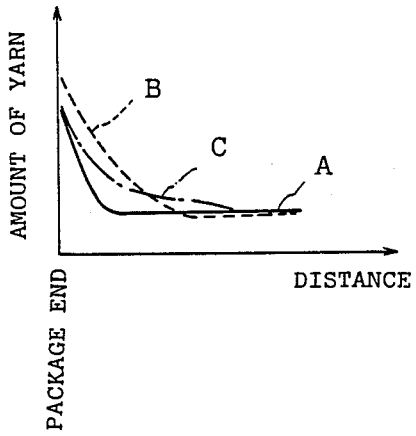
FIG. 9 is a diagram showing the relationship between position in a package and the amount of yarn wound on the package of FIG. 8.

If yarns are wound along the traverse speed lines A, B and C illustrated in FIG. 8, high shoulders are formed in shapes illustrated by a solid line A, a broken line B and a dot and dash line C in FIG. 9.

According to the present invention, the traverse speed is increased along the solid line A in FIG. 8 at the beginning of the accelerating operation. Since the traverse speed is increased along the critical traverse speed line A, the a yarn can be wound into a package without being subjected to a tension variation. Further, the amounts of the high shoulders are set substantially the same for the lines B and C, and therefore, the amounts of the high shoulders in the obtained packages become substantially the same, if the leveling ranges are set at almost the same level. Thus the package obtained by the method of the present invention is free from slippage of wound yarn from the shoulders. In addition, the yarn inclination at the ends of the package of the present invention can be small compared with that in the package obtained by the traverse speed line A.

Furthermore, according to the present invention, the tension in yarn at the beginning of the acceleration of the traverse speed is not excessively small. Accordingly, decrease of hardness at the shoulders or bulges from the side surface does not occur. Even when a yarn having a large elasticity, such as a covered yarn, is wound according to the method of the present invention, the yarn located at the shoulders of the package is not contracted with the passage of time after completion of the winding operation. Therefore, adjacent yarns do not easily overlap nor entangle with each other, and the unwinding ability can be high.

In the foregoing description, the rate of change of the traverse speed is changed once; however, according to the present invention, the rate may be change twice or more.

Figure 10:
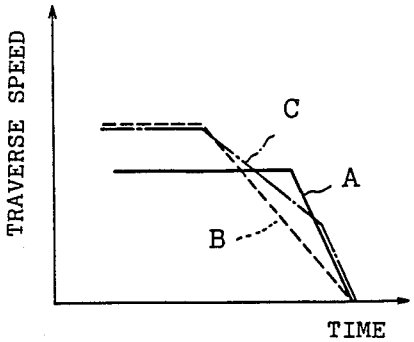
FIG. 10 is a diagram showing the relationship between time and traverse speed of the present invention.

Further, the foregoing description has related to the acceleration from the turning point of the traverse motion, however, the present invention is also applicable to the deceleration to the turning point of the traverse motion as illustrated by a dot and dash line C in FIG. 10. In this case, the rate of change of the traverse speed is increased at least once during decelerating operation from the predetermined traverse speed to the traverse speed of zero. Especially, as designated by a dot and dash line C, it is preferable that the traverse speed is decelerated at a rate of change of the traverse speed which is lower than a rate of change of a traverse speed that gives a desired leveling range of the shoulders as designated by a broken line B, and then the rate of traverse speed is increased to such an extent so as to avoid substantial tension variation at the shoulders as designated by solid line A.

The above-described embodiments may be combined with each other if it is desired, and further the above described traverse pattern may be altered within the scope of the present invention.

As described above, according to the present invention, a method for winding a cross-wound package is provided, by which slip down of a wound yarn and ribboning are prevented from occurring.

As described above, when the leveling of the shoulders of a package is taking place as illustrated in FIG. 6, a number of shoulder patterns which have been obtained in accordance with steps described with reference to FIG. 5 are prepared and are overlapped at turning points as illustrated in FIG. 7. In short, this means that the high shoulders illustrated in FIG. 5 at a certain turning point are distributed in a leveling range.

Accordingly, if a basic traverse pattern is determined, and the turning points are set between the outermost turning point of the traverse stroke and the innermost turning point of the traverse stroke, the high shoulder patterns similar to that illustrated in FIG. 7 can be obtained for all the set turning points, and shoulder shape can be drawn by overlapping the obtained high shoulder patterns.

However, if the turning points are not randomly distributed in view of the passage of time, similar traverse motions may be repeated at certain turning points which are specially correlated to each other. As a result, ribboning may occur. Further, as described above, if all the turning points of all the traverse strokes are sequentially input into a control system, it is not easy to randomly arrange the turning points. Therefore, according to the present invention, the allotment of the turning points is made random in the following manner.

First, a basic traverse pattern is determined based on the shape of the shoulders of the package in a manner described with reference to FIGS. 4 and 5 or in a manner described with reference to FIGS. 8 and 10.

Then, in the leveling diagram illustrated in FIG. 6, the innermost switching point $S_1$ is set at a position inside from the outermost switching position $S_0$ by a distance L which is equal to the leveling range.

Thereafter, the region between the outermost switching point $S_0$ and the innermost switching point $S_l$, i.e., the region with distance L for leveling the shoulders, is divided into a plurality of points, i.e., 0, 1, 2, $\cdots$ n, from the outermost point of the traverse stroke toward the innermost point. The plurality of points may be divided at unequal distances, but, it is preferable that the points are equally divided so as to facilitate easy allotment. In order to enhance effects for preventing ribboning, the number of divisions is set between about 3 and 100, and it is preferable that the number is set between about 20 and 50, in order to enhance the effects and easily allot the points.

Figure 12:
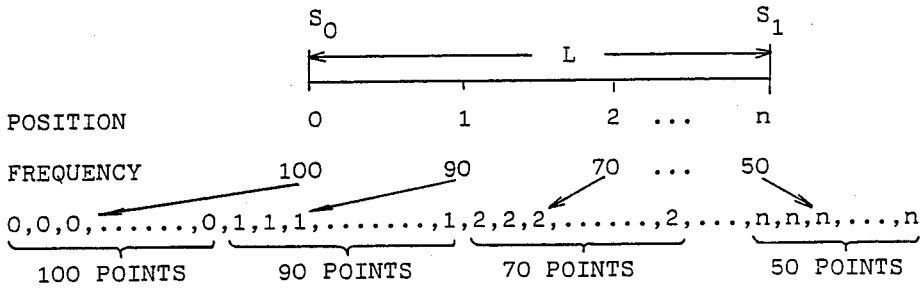
FIG. 12 is a diagram explaining steps for dividing into a plurality of points and allotting frequencies to the points.

The frequencies for switching operation, i.e., probabilities wherein the stroke ends reach the points, are allotted to the plurality of points in a manner illustrated in FIG. 12. The allotment of the frequency to the points may be percentages, such as 10%, 9%, 7%, $\cdots$ 5%, or absolute numbers, such as, 100, 90, 70, $\cdots$ 50. In the latter case, if it is assumed that the sum of the numbers is 1000, the probabilities at points 0, 1, 2, $\cdots$ n are $100\% \times 100/1000 = 10\%$, $100\% \times 90/1000 = 9\%$, $100\% \times 70/1000 = 7\%$, $\cdots$ $100\% \times 50/1000 = 5\%$. In the former method, attention must be paid so that the sum of the frequencies at all the points be 100%. Contrary to this, the latter method is easier than the former method because no special attention is required even if the sum is changed from, for example, 1000 to 750.

When the allotment of the frequencies at the points is altered, the superimposed shoulder pattern of a package illustrated in FIG. 7 is changed. Accordingly, in the present invention, shape of shoulders in a package can be foreseen from a calculating operation by determining the basic traverse pattern and allotting the frequencies to the points.

After the frequencies are allotted to the points, switching points, the numbers of which correspond to the frequencies, respectively, are prepared for the points.

More specifically, when the frequencies are given in percentages, the total number of occurrences, for example, 1000, is also given, and the above described percentages are multiplied with the total number, and 100, 90, 70, $\cdots$ 50 points are prepared for the positions 0, 1, 2, $\cdots$ n. In other words, the 100 of 0, 90 of 1, 70 of 2, $\cdots$ 50 of n are prepared.

When the frequencies are given in absolute numbers, the points corresponding to the absolute numbers are prepared. If the number of occurrence is too large or too small, the numbers of points are decreased by dividing a certain number or increased by multiplying a certain number.

Then, the switching points thus prepared are disposed substantially at random so that the shoulders are formed in the above-described shape without causing ribboning. The following methods can be automatically applied by way of an electronic computer to randomly dispose the points.

Figure 13A:
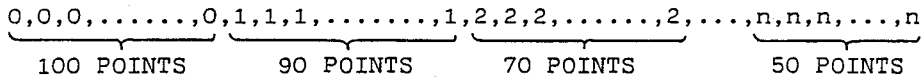
FIG. 13 (*a*) and FIG. 13 (*b*) are diagrams explaining a step for allotting frequencies.
Figure 13:
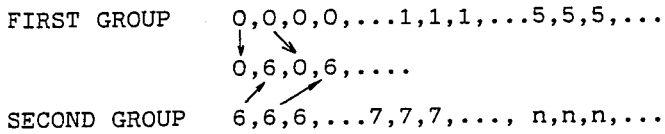

In the first method, 100, 90, 70, $\cdots$ 50 points prepared for the positions 0, 1, 2, $\cdots$ n are placed in a row as illustrated in FIG. 13 (*a*), and then the placed points are divided at the center into two groups as illustrated in FIG. 13 (*b*). In other words, the first to the five hundredth points are assigned to the first group, and the five hundred and first to the thousandth points are assigned to the second group. Then, points are alternately picked up from the first and second groups. More specifically, the points are picked up in the following manner, the first point in the first group (0), the first point in the second group (6), the second point in the first group (0), the second point in the second group (6). According to this method, the correlation between the adjacent points can be diminished, however, the correlation may remain between every other point.

If the number of the groups into which the switching points are divided is further increased, for example to four, the correlation between the adjacent points or between every some points may be lowered to some extent. However, some extent of correlation may remain because the points are regularly disposed. If it is the case, the following method is recommended.

In the second method, the table of random numbers, for example 03, 47, 43, 73, 86, 36, 96, $\cdots$, comprised of, for example, 300 numbers are input in an electronic computer from the numbers from 00 to 100 or psuedo-random numbers are generated in accordance with a conventionally known method in an electronic computer. If a predetermined table of random numbers is previously memorized in an electronic computer, or psuedo-random numbers are generated based on a predetermined initial condition, the same table of random numbers can be reappeared, and accordingly, the same winding conditions can be preferably realized again if the same initial conditions are given.

Similar to the steps in FIG. 13 (*a*), 100, 90, 70, $\cdots$ 50 points prepared for the positions 0, 1, 2, $\cdots$ n are placed in a row as shown in FIG. 14 (*b*). Then these points are replaced in accordance with the table of random numbers.

The method for replacement is as follows. The random number x, for example 56, located at the position a, for example 101st point, is multiplied with a. Then the product is divided by 100, i.e., $101 \times 56/100$, and the fractions are omitted, and accordingly 56 is obtained. Thus the number (1) located at position a (101st position) is moved to the position (56th position) corresponding to the obtained number (56). The above-described steps are performed for all the points.

The points randomly disposed in the foregoing manner are used as the turning points of the traverse motion, and the traverse motion is carried out in accordance with such a basic traverse pattern as illustrated in FIGS. 4, 5, 8 or 10 which are determined in accordance with the shape of the shoulders of the desired cross-wound package.

It is preferable that the imaginary line connecting the turning points of the traverse motion has extreme values, i.e., maximum values or minimum values, at every turning point.

The control sequence of the traverse ends may be differently started at both the ends. If such a method is applied, leveling conditions are different at both the ends, and the effects for preventing ribboning can be enhanced.

The turning points may be further distributed in order to enhance effects for preventing ribboning or to scatter the hardness of the shoulders in an axial direction of the package.

For example, in FIG. 12, only the position 0 is not distributed and is remains at the end of the package, and utilizing the table of random numbers, the 90 data set at position 1 are substantially distributed between position 0 and position 1, and the 70 data set at position 2 are substantially distributed between position 1 and position 2. Similarly, points set at the positions are distributed. According to this method, similar advantages are achieved as those achieved by increasing the number of divided positions n in the leveling range L, while the disposing operation is easy.

What is claimed is:

1. A method for level winding a cross-wound package, comprising the steps of:

traversing the yarn from a first traverse end to a second traverse end, reversing the direction of traverse at turning points at each of said first and second traverse ends wherein the traverse speed is zero at said turning points at each traverse end, accelerating the traverse speed rapidly from a traverse speed of zero to a predetermined traverse speed while traveling between the traverse ends, decelerating the traverse speed rapidly from the predetermined traverse speed to a traverse speed of zero at a position just before each of the first and second traverse ends, and changing the rate of acceleration at least once between the traverse speed of zero and the predetermined traverse speed and changing the rate of such that turning points of said first and second traverse ends are at different positions for different traverse strokes, wherein shoulders of said package are leveled.

2. A method for winding a cross-wound package according to claim 1, wherein said step of changing the rate of acceleration includes the step of decreasing said rate of change of said traverse speed at least once during acceleration from said traverse speed of zero to said predetermined traverse speed.

3. A method for winding a cross-wound package according to claim 1, wherein said step of changing the rate of deceleration includes the step of increasing said rate of change of said traverse speed at least once during deceleration from said predetermined traverse speed to said traverse speed of zero.

4. A method for leveling shoulders of a cross-wound package, comprising the steps of rotatably supporting a bobbin for winding a yarn thereon, connecting a traverse guide, which is traversed to a fro along the axis of said bobbin, to a means for reversible movement, and changing points at which said reversible movement means causes a turning point, in such a manner that an imaginary line connecting turning points of traverse motion at each package end on a traverse stroke vs. time duration diagram forms bending points at turning points, characterized by the steps of:

setting an innermost switching point at a position inside form an outermost switching point of a traverse stroke of said reversible movement means, in accordance with a desired leveling of said shoulders formed at ends of said package, where said switching points correspond to positions of said turning points;

dividing a zone between said outermost switching point and said innermost switching point into a plurality of points;

allotting frequencies to said plurality of points;

preparing intermediate switching points between said innermost and outermost switching points, the number of which corresponds to said frequencies;

disposing said prepared switching points substantially at random; and performing traverse motion turning at said substantially randomly disposed switching points in accordance with a basic traverse pattern, which is set based on said desired leveling of said shoulders.

* * * * *